United States Patent [19]

King

[11] 3,939,980

[45] Feb. 24, 1976

[54] NESTING CONTAINER

[75] Inventor: Clarence J. King, Ludington, Mich.

[73] Assignee: Straits Steel & Wire Co., Ludington, Mich.

[22] Filed: July 10, 1974

[21] Appl. No.: 487,001

[52] U.S. Cl. ..... 206/507; 206/513; 206/520; 220/19

[51] Int. Cl.[2] ..... B65D 7/20; B65D 21/04

[58] Field of Search ..... 220/19; 206/503, 507, 513, 206/505; 211/126, 181

[56] References Cited

UNITED STATES PATENTS

| | | | |
|---|---|---|---|
| 2,585,422 | 2/1952 | Averill | 220/19 |
| 2,916,293 | 12/1959 | Lang | 206/513 |
| 2,964,211 | 12/1960 | Pfeffer | 220/19 |
| 3,082,879 | 3/1963 | Wilson | 206/505 |

*Primary Examiner*—George E. Lowrance
*Attorney, Agent, or Firm*—Price, Heneveld, Huizenga & Cooper

[57] ABSTRACT

A stackable-nestable container is disclosed having a rim defining the top thereof. The rim along each side is recessed with the recesses terminating in upstanding shoulders adjacent each end. The rim across each end of the container is recessed below the bottom of the recesses in the sides. The container has a pair of legs, one at each end. The height of the legs is substantially equal to the difference in depth between the side and end recesses whereby, when the containers are telescopically nested, an access opening extends between containers for receiving the tines of a forklift as a result of the legs of the upper of two containers resting on the bottom of the container beneath. The lengthwise spacing between the legs equals the width of the container at the top rim and the length of the recesses in the sides of the rim equals the lateral spacing of the legs to permit interlocked stacking when alternate containers are rotated 90° with respect to each other. Also, an access opening is provided for insertion of the tines of a forklift.

3 Claims, 6 Drawing Figures

NESTING CONTAINER

FIELD OF THE INVENTION

This invention relates to containers and particularly to containers fabricated of wire or rod which are both stackable and nestable. While the invention involves a container construction which can be made in any suitable size, it is particularly intended for large size containers intended to be handled by mechanized lifting means such as forklift trucks. Containers made of wire or rod and designed for either stacking or nesting are well-known. However, prior art containers of this type, when stacked, have not provided a combination of stability and convenient engagement by mechanical lifting and transport devices such as a forklift truck. It is the object of this invention to provide a container having these features and the ability to nest compactly all combined in a simple, strong yet relatively inexpensive construction.

BRIEF DESCRIPTION OF THE INVENTION

The container of this invention has a lower rim which acts as a base frame to which is welded a grid of rods or wires arranged in an intersecting pattern and welded to provide a rigid structure. The ends of the rods or wires forming the grid are turned up to form upstanding sides and ends. The sides and ends are slightly outwardly tapered. The upper ends of the sides and ends are welded to an upper or top rim. This rim is shaped to provide a recess adjacent each end of the container on each side. The recesses are terminated adjacent the ends by upwardly extending shoulders formed in the upper rim. The spacing between the shoulders on each side is equal to the lateral width of the lower rim. At each end of the container, outwardly of the shoulders, the upper rim dips down sharply whereby, accross the ends of the container, the rim is well below the level of the bottoms of the recesses formed in the rim along the side. This structure is designed to cooperate with the lower rim or base which, at each end, has a downwardly extending leg or hook. The spacing between the legs is equal to the span of the container between its sides whereby one container can be stacked upon another when rotated 90°, with the legs of the lower rim seated down over the sides of the upper rim of the container below and the shoulders defining the recesses in the sides of the upper rim nesting and centering the container. It will be seen that this arrangement provides stability in both directions for the stacked containers. The deeper recessing of the ends provides a passageway between the upper and lower containers into which the tines of the lifting device such as a forklift truck can be inserted for stacking and unstacking the containers.

DESCRIPTION OF THE PREFERRED EMBODIMENT

Figure 1:
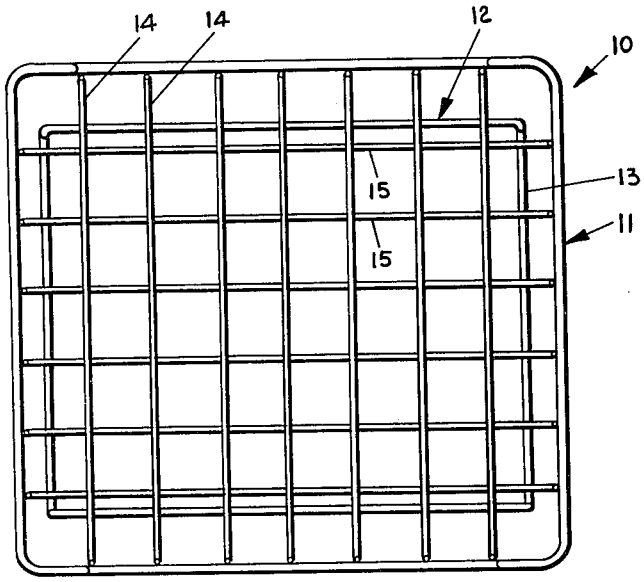
FIG. 1 is a plan view of a container constructed according to this invention.

Referring to FIG. 1, the container 10 has an upper or top rim 11 and lower rim or base frame 12. Both of these structures are rectangular with the lower rim or base frame enclosing a smaller area than the upper rim 11.

The lower rim 12, at each end, has a pair of depending legs 13. The legs 13 serve as supports when the containers are nested and when the individual container rests on a floor. They also serve the dual purpose of stabilizing hooks when the containers are stacked. This will be explained subsequently. The floor or bottom of the container consists of a grid formed by a plurality of parallel lateral rods or wires 14 which are arranged to intersect a second group of parallel endwise extending wires or rods 15. At each point of intersection, the wires 14 are welded to the wires 15 to provide a strong, rigid bottom or floor for the container. This grid rests upon and is welded to the lower rim or base frame 12 at each point of bearing between the lower rim and the grid.

Figure 4:
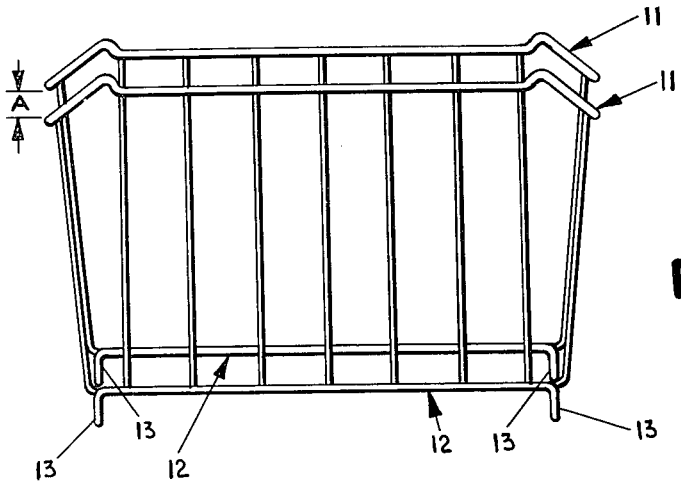
FIG. 4 is a side elevation view of a pair of the containers nested for storage.
Figure 3:
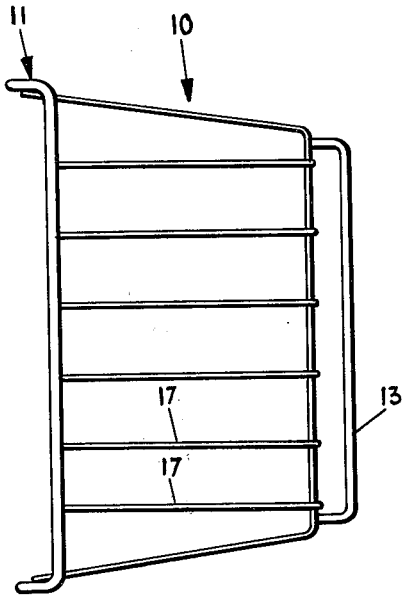
FIG. 3 is an end elevation view of the container shown in FIG. 1.

On both sides of the container, the ends of the lateral members 14 are turned upwardly to provide side members 16. At both ends of the container, the ends of the lengthwise members 15 are turned upwardly to form the end elements 17 of the container. The top ends of the side elements 16 and end elements 17 are welded to the inside face of the upper rim 11. It will be noted from observing FIGS. 3 and 4 that the size and shape of the lower rim or base frame member 12 is less than that of the grid and, thus, is offset inwardly from the bottoms of the side elements 16 and the end elements 17 where they are bent to form the grid serving as the bottom of the container.

Figure 2:
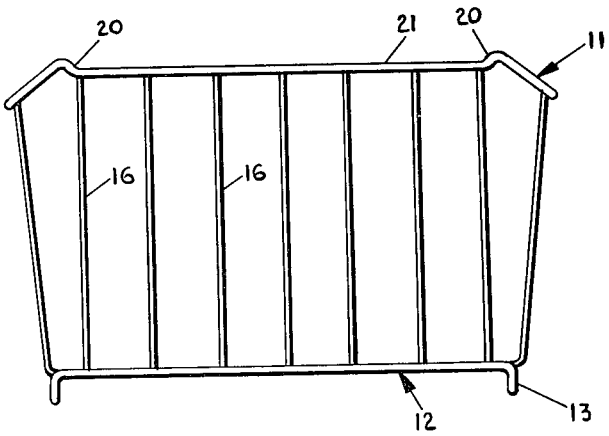
FIG. 2 is a side elevation view of the container shown in FIG. 1.
Figure 5:
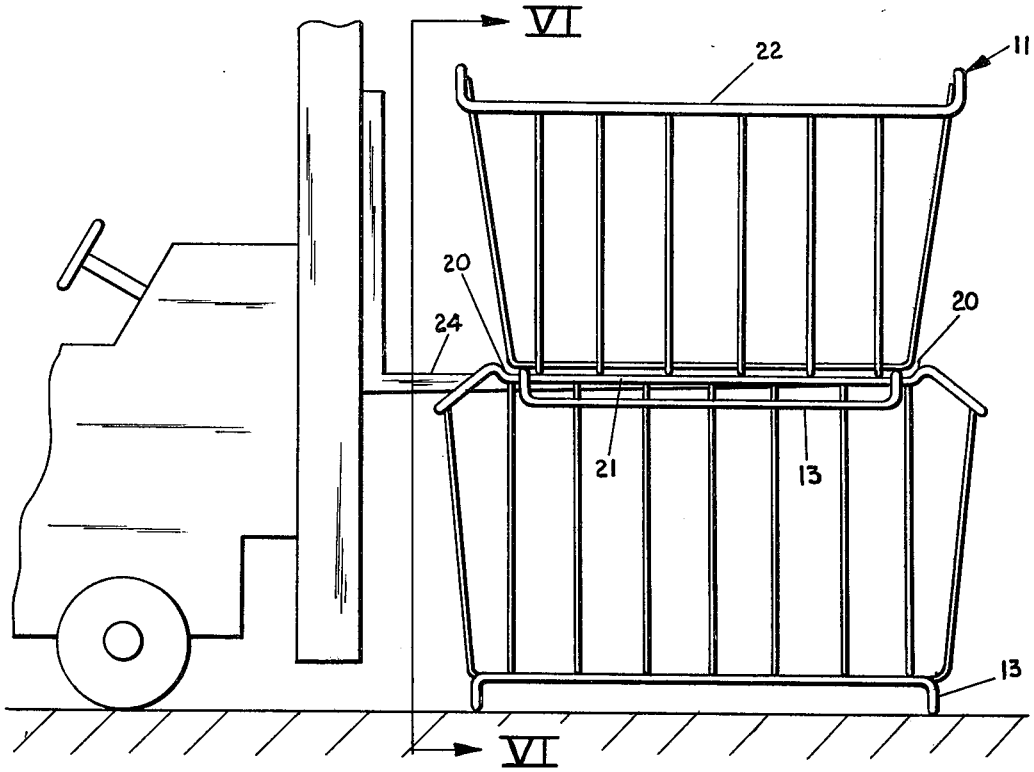
FIG. 5 is an elevation view of a pair of the containers in stacked relationship.

As best seen in FIG. 2, along the sides of the container, the upper rim 11 is recessed downwardly to form an elongated section or pocket which terminates adjacent each end of the container in an upwardly extending stop or shoulder 20. The spacing between the shoulders 20 is equal to the lateral width of the lower rim member or element 12. By reason of this, the legs 13 can be seated over the recessed side portions of the rim 11 with the lateral or side portions of the lower rim 12 seated closely adjacent or at the shoulder 20. It is important that the shoulders closely confine the rim of the container above to prevent sliding and relative displacement of the containers.

Figure 6:
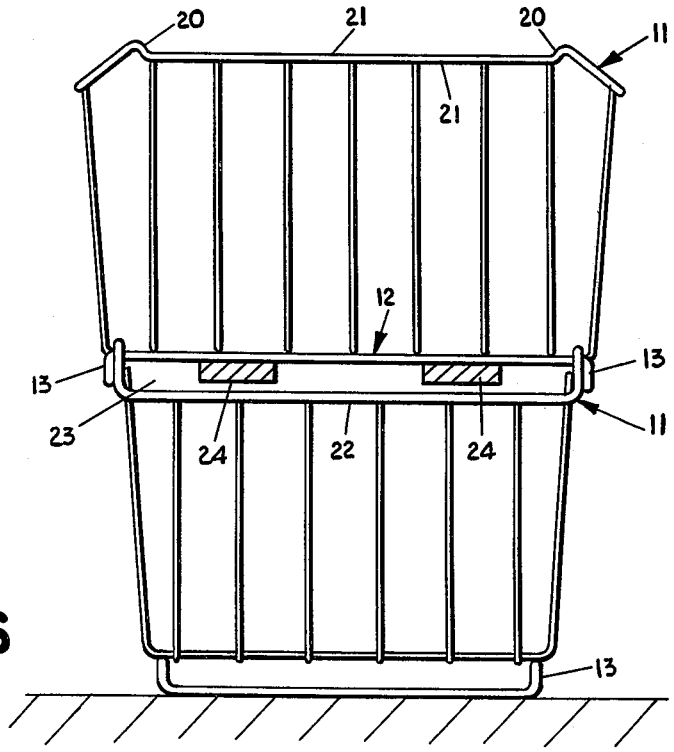
FIG. 6 is a sectional elevation view taken along plane VI—VI of FIG. 5.

At each end of the container, outwardly of the shoulders 20, the upper rim is sloped sharply downward to a point well below the bottom of the recess 21 formed in the sides of the container. The depressed portion of the ends of the rim 11 extends the full width of the top of the container, as is shown in FIG. 6, forming a wide opening 23 between the downwardly recessed end portion 22 of the upper rim of a lower container and the bottom surface of the lower rim element 12 of the upper of a pair of stacked containers. This spacing is such as to permit the operator for a device such as a forklift truck to insert the tines 24 of the truck through the opening formed above the ends of the lower of the containers. This permits mechanical handling of the containers such as for stacking or unstacking. This is essential when the containers are large or are heavily loaded.

By mounting the vertical end and side elements to the inside of the upper rim, the exterior of the top rim of the container is smooth. This permits the containers to be placed close together without interlocking or snagging. This faciitates stacking and unstacking when the columns of stacked ccontainers are closely packed. It reduces the potential of damage to adjacent articles or walls. It is also a safety factor for personnel working with these containers. Because the containers, when nested, are spaced apart the height of the legs 13, the containers are prevented from becoming wedged one into the other. Because the legs are short, the containers will only nest compactly for vertical storage. By eliminating the wedging action between containers, they can be more easily nested and unnested and damage to the face of the container is materially reduced.

It will be noted that the height of the legs 13 is substantially equal the height of the tine receiving opening 23 which remains when a pair of containers are stacked. This results from the fact that the vertical difference between the bottom of the recesses 21 and the end of the top rim is basically equal to the height of the legs 13. By this construction, when the containers are nested for storage, the tines can be inserted through the ends in the spacing A (FIG. 4) between two nested containers. This permits one or several of the containers to be nested or removed from a stack of stored containers. For this purpose, the spacing between certain of the end elements can be varied to provide added lateral access for the tines 24. The entire stack can be similarly moved by insertion of the tines through the legs 13 of the bottom container. Since the legs form loops around the tines, the container or stack of containers, when so lifted, is positively held on the tines. This is a further safety factor in handling the containers.

The containers, by their construction, provide a stable stack in which the containers are positively locked against relative endwise or lateral movement with respect to each other. This is very important in providing a stack which is safe from possible misalignment and tipping. In the case of large or heavily loaded containers, this is an important safety factor for personnel. Further, because the containers when stacked make bearing contact substantially at the four corners of the container, the large base area of support of the containers also adds to the stability of the stacked containers, again contributing to the safety of this type of container. The use of the short legs also positively holds the contents of the containers off a floor or other surface, thus preventing damage from any substances which might be on the floor such as dirt, oil, moisture and the like.

It will be recognized while a preferred embodiment of this invention has been illustrated and described that modifications may be made without departing from the principles of the invention.

The embodiments of the invention in which an exclusive property or privilege is claimed are defined as follows:

1. A stackable-nestable container for storage and transport of articles, said container having an upper rim and a lower rim, a bottom formed of a grid of interconnected, intersecting wires, both ends of said wires of said grid being bent to extend upwardly to form the ends and sides of said container, the tops of said upstanding wires being rigidly secured to said upper rim, said lower rim being rigidly secured to said grid, said container characterized in that the side portions of said upper rim are provided with recesses, said recesses adjacent the ends of said container terminating in an upstanding shoulder, one adjacent each end of said container; said lower rim being ring-shaped and secured to the underside of the bottom of said container, the ends of said lower rim extending downwardly to form a pair of spaced leg-hooks and the sides of said rim being nested firmly against and secured to said bottom, said legs of an upper container resting on the bottom of a lower container when the containers are nested whereby the load of the upper of said containers when nested is supported entirely by its legs and the bottom of the container beneath; the spacing between said leg-hooks being such as to receive the side portions of the top rim therebetween and the horizontal length of said side hooks being such as to seat in said side portion recesses of said side portion recesses of said upper rim closely adjacent said upstanding shoulders whereby one container can be stacked upon another like container when the sides of the one container are parallel to the ends of the other container, and when so stacked, said leg-hooks prevent relative displacement of said containers with respect to each other in one direction and said shoulders prevent relative displacement in the other direction.

2. A stackable-nestable container as described in claim 1 wherein the end portions of said upper rim are recessed below the recesses in said side portions of said upper rim to provide an access opening extending between said recessed ends when a pair of said containers are stacked; said access opening being of a height to receive the tines of a forklift truck for vertically separating the upper container of a pair of stacked containers from the container beneath.

3. A stackable-nestable container as described in claim 2 wherein said access openings extend the full width of said container.

* * * * *